US011885136B2

(12) United States Patent
Holten et al.

(10) Patent No.: US 11,885,136 B2
(45) Date of Patent: Jan. 30, 2024

(54) HANDRAIL, KIT, AND METHOD FOR INSTALLATION OF SAME

(71) Applicant: InPro Corporation, Muskego,, WI (US)

(72) Inventors: Andrew R. Holten, Muskego, WI (US); Matthew G. Bennett, New Berlin, WI (US)

(73) Assignee: InPro Corporation, Muskego, WI (US)

( * ) Notice: Subject to any disclaimer, the term of this patent is extended or adjusted under 35 U.S.C. 154(b) by 64 days.

(21) Appl. No.: 17/679,912

(22) Filed: Feb. 24, 2022

(65) Prior Publication Data

US 2022/0213691 A1 Jul. 7, 2022

Related U.S. Application Data

(63) Continuation of application No. 16/376,805, filed on Apr. 5, 2019, now abandoned.

(51) Int. Cl.
*E04F 11/18* (2006.01)

(52) U.S. Cl.
CPC ..... *E04F 11/1804* (2013.01); *E04F 11/1808* (2013.01); *E04F 2011/1889* (2013.01); *E04F 2011/1897* (2013.01)

(58) Field of Classification Search
CPC ..... E04F 2011/1889; E04F 2011/1897; E04F 11/1802; E04F 11/1808
See application file for complete search history.

(56) References Cited

U.S. PATENT DOCUMENTS 3,825,229 A * 7/1974 Bartlett ..... E04F 11/1804 248/251
3,991,537 A * 11/1976 Brown ..... E04F 19/026 52/312

(Continued)

FOREIGN PATENT DOCUMENTS

| | | | | |
|---|---|---|---|---|
| CN | 105275164 | | 1/2016 | |
| CN | 105275164 | A | 1/2016 | |
| EP | 1643055 | A1 * | 4/2006 | ..... E04F 11/1804 |
| JP | H06248772 | A | 9/1994 | |
| JP | 2001323623 | A | 11/2001 | |

OTHER PUBLICATIONS

New York State Office of Mental Health, "Patient Safety Standards, Materials and Systems Guidelines," pp. 90-94, 21st Edition, Mar. 11, 2019, accessed on the internet [https://www.omh.ny.gov/omhweb/patient_safety_standards/guide.pdf], 211 pages.

(Continued)

*Primary Examiner* — Joshua T Kennedy
(74) *Attorney, Agent, or Firm* — Reinhart Boerner Van Deuren s.c.

(57) ABSTRACT

A handrail kit that includes a cover, a first endcap, a second endcap, and a support member is provided. The support member includes a longitudinal axis, a first end along the longitudinal axis, a second end along the longitudinal axis, a first lateral side, a second lateral side, a first longitudinal side, and a second longitudinal side. The first lateral side of the support member is configured to be secured directly against a mounting surface. The first endcap is configured to mate with the first end of the support member and the second endcap is configured to mate with the second end of the support member. The cover is configured to be placed over the second lateral side of the support member and to engage the first longitudinal side and the second longitudinal side of the support member.

8 Claims, 6 Drawing Sheets

(56) References Cited

U.S. PATENT DOCUMENTS

| | | | | |
|---|---|---|---|---|
| 4,196,552 | A | 4/1980 | Bartlett | |
| 4,201,359 | A | 5/1980 | Baslow | |
| 4,353,529 | A * | 10/1982 | Brown | E04F 11/1804 248/345.1 |
| 5,165,643 | A | 11/1992 | Shreiner | |
| 5,273,258 | A | 12/1993 | Bedics | |
| 5,469,682 | A | 11/1995 | Knight | |
| 5,743,064 | A * | 4/1998 | Bennett | B29C 66/71 52/312 |
| 5,908,185 | A * | 6/1999 | Collette | E04F 11/1804 248/345.1 |
| 6,508,458 | B1 | 1/2003 | Bartlett et al. | |
| 9,644,836 | B1 * | 5/2017 | Field | F21S 4/28 |
| 10,480,195 | B2 | 11/2019 | Warshaw | |
| 10,813,455 | B2 * | 10/2020 | Ustach | F16B 5/128 |
| 2004/0227135 | A1 * | 11/2004 | Shreiner | E04F 11/1804 256/65.16 |
| 2006/0272255 | A1 * | 12/2006 | Honda | E04F 19/02 52/506.05 |

OTHER PUBLICATIONS

Construction Specialties Group, "HRB-4CCMN," Dec. 12, 2012, accessed on the Internet [https://www.c-sgroup.com/files/tech-center/acrovyn/cad/pdf/hrb4ccmn.pdf], 1 page.

Construction Specialties Group, "HRB-4CCMN Handrail with Ligature Resistant Mounting Bracket," Installation Guide, Mar. 27, 2015, accessed on the Internet [https://www.c-sgroup.com/files/tech-center/acrovyn/install/pdf/24hrb4ccmn.pdf], 7 pages.

Construction Specialties Group, "HRB-20CMN ACROVYN 4000," Dec. 12, 2012, accessed on the Internet [https://www.c-sgroup.com/files/tech-center/acrovyn/cad/pdf/hrb-20cmn.pdf], 1 page.

Construction Specialties Group, "HRB-20CMN Handrail with Ligature Resistant Mounting Bracket," Dec. 12, 2012, accessed on the Internet [https://www.c-sgroup.com/files/tech-center/acrovyn/install/pdf/hrb-20cmn.pdf], 7 pages.

Pawling Corporation, "Pro Tek Installation Instruction, BR-500 Series Handrail with Continuous Security Bracket," available on Jan. 10, 2019, 4 pages.

Pawling Corporation, "Pro Tek Installation Instruction, BR-400V Series Handrails," available on Jan. 10, 2019, 4 pages.

* cited by examiner

HANDRAIL, KIT, AND METHOD FOR INSTALLATION OF SAME

CROSS-REFERENCE TO RELATED PATENT APPLICATIONS

This application is a continuation of U.S. patent application Ser. No. 16/376,805, filed Apr. 5, 2019, and the content of which is incorporated herein by reference in its entirety.

BACKGROUND OF THE INVENTION

The present invention relates generally to the field of handrails. The present invention relates specifically to handrails usable in behavioral health facilities.

In behavioral health facilities, some patients are at risk of harming themselves and will use whatever objects that may be around them to that effect. Thus, in behavioral health facilities, structures and components must be designed to substantially limit their ability to be used by patients who may wish to harm themselves. Embodiments of the present invention relate to a handrail system that addresses this need in the art.

SUMMARY OF THE INVENTION

One embodiment of the invention relates to a handrail kit. The handrail kit includes a cover, a first endcap, a second endcap, and a support member. The support member includes a longitudinal axis, a first end along the longitudinal axis, a second end along the longitudinal axis, a first lateral side, a second lateral side, a first longitudinal side, and a second longitudinal side. The first lateral side of the support member is configured to be secured directly against a mounting surface. The first endcap is configured to mate with the first end of the support member and the second endcap is configured to mate with the second end of the support member. The cover is configured to be placed over the second lateral side of the support member and to engage the first longitudinal side and the second longitudinal side of the support member.

Another embodiment of the invention relates to a method of installing a handrail. The handrail includes a first endcap, a second end cap, a support member, and a cover. The support member has a longitudinal axis, a first end along the longitudinal axis, a second end along the longitudinal axis, a first lateral side, a second lateral side, a first longitudinal side, and a second longitudinal side. In the method, the first endcap is mated to the first end of the support member, and the second endcap is mated to the second end of the support member. The first lateral side of the support member is attached directly to a mounting surface, and the cover is attached to the support member over the first longitudinal side and the second longitudinal side.

Another embodiment of the invention relates to a handrail. The handrail includes a support member having a longitudinal axis, a first end along the longitudinal axis, a second end along the longitudinal axis, a first lateral side, a second lateral side, a first longitudinal side, and a second longitudinal side. The handrail also includes a first endcap mated with the first end of the support member and a second endcap mated with the second end of the support member. Further, the handrail includes a cover placed over the second lateral side of the support member and engaged with the first longitudinal side and the second longitudinal side of the support member. The first lateral side of the support member is configured to be secured directly against a mounting surface.

Alternative exemplary embodiments relate to other features and combinations of features as may be generally recited in the claims.

BRIEF DESCRIPTION OF THE DRAWINGS

The disclosure will become more fully understood from the following detailed description, taken in conjunction with the accompanying figures, wherein like reference numerals refer to like elements, in which.

DETAILED DESCRIPTION

Before turning to the figures, which illustrate the exemplary embodiments in detail, it should be understood that the present invention is not limited to the details or methodology set forth in the description or illustrated in the figures. It should also be understood that the terminology is for the purpose of description only and should not be regarded as limiting.

Generally, a handrail that is easier to install and more difficult to disassemble than conventional handrails is provided. In particular, the handrail includes a single piece support member that connects directly to the mounting surface (e.g., wall). The handrail cover snaps onto the support member in such a way that removal is difficult. In certain conventional designs, the handrail cover could be dislodged and used by a patient in a behavior health facility to harm himself/herself or others, or the patient could use the exposed handrail support member to injure himself/herself. Despite being more difficult to disassemble, the handrail is easier to assemble and install than other conventional designs, especially those requiring a backer board or mounting bracket to mount the support member to the wall. These and other advantages will be discussed in relation to the exemplary embodiments provided below.

Figure 1:
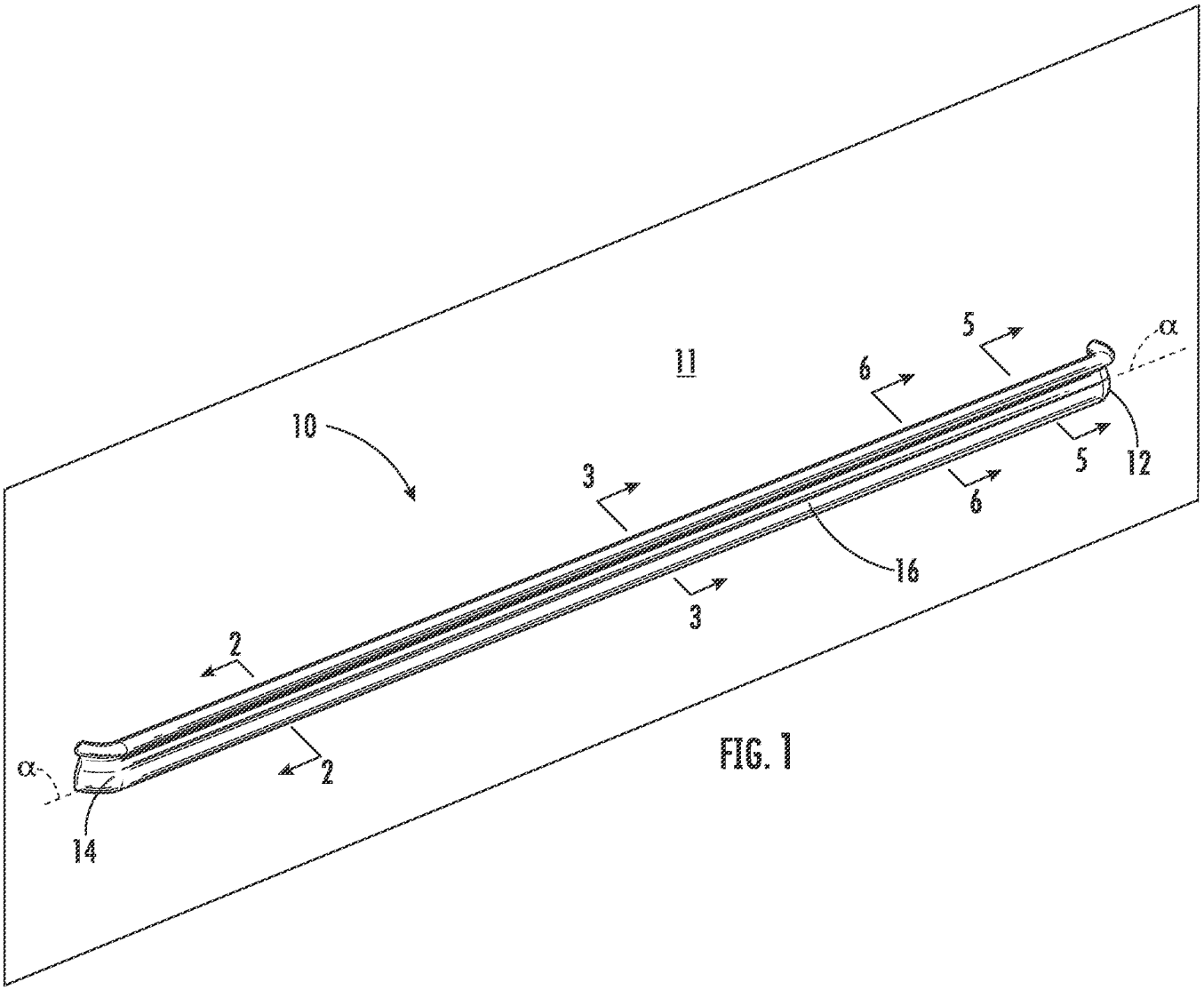
FIG. 1 depicts a perspective view of the handrail system, according to an exemplary embodiment.

Referring to the FIG. 1, an embodiment of a handrail 10 is depicted. As shown in FIG. 1, the handrail 10 is attached to a mounting surface 11, such as a wall of a building. The handrail 10 includes a first endcap 12, a second endcap 14, and a handrail cover 16 that is disposed between the first endcap 12 and the second endcap 14. The endcaps 12, 14 may also be referred to as "returns." As can be seen in the embodiment depicted in FIG. 1, the endcaps 12, 14 and cover 16 define a substantially continuous surface along longitudinal axis a having corresponding curvatures going from the top of the handrail system 10 to the bottom of the handrail 10 (with respect to the orientation shown in FIG. 1). In embodiments, the cover 16 and the endcaps 12, 14 are both comprised of a plastic material. In particular, the cover 16 and endcaps 12, 14 are preferably made from an impact resistant plastic. In an embodiment, the cover 16 is made from PVC. Further, in embodiments, the cover 16 is an extruded component. In embodiments, the endcaps 12, 14 are made from PVC or ABS. In embodiments, the endcaps 12, 14 are molded, e.g., injection molded, or made through additive manufacturing, e.g., 3D-printing.

Figure 2:
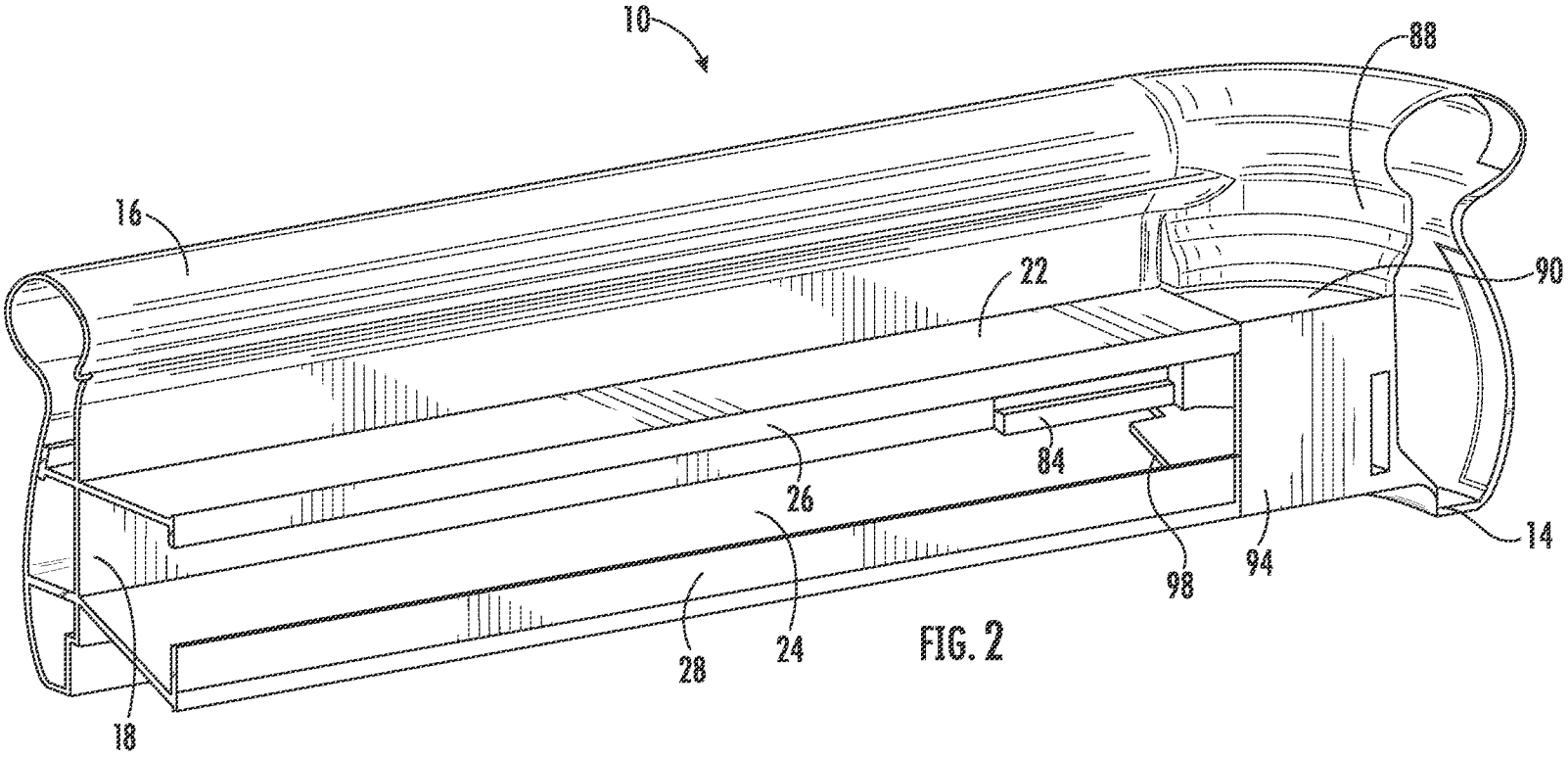
FIG. 2 depicts a cross-sectional, perspective view of the handrail system of FIG. 1 taken along line 2-2.

FIG. 2 provides a perspective and partial-sectional view of the handrail 10, showing the rear, wall-facing side of the handrail 10. As can be seen in FIG. 2, the cover 16 is snapped over a handrail support member 18, which will be discussed in more detail in relation to FIG. 3. Additionally, the endcap 14 engages an end of the handrail support member 18 as will be discussed more fully below in relation to FIG. 4.

Figure 3:
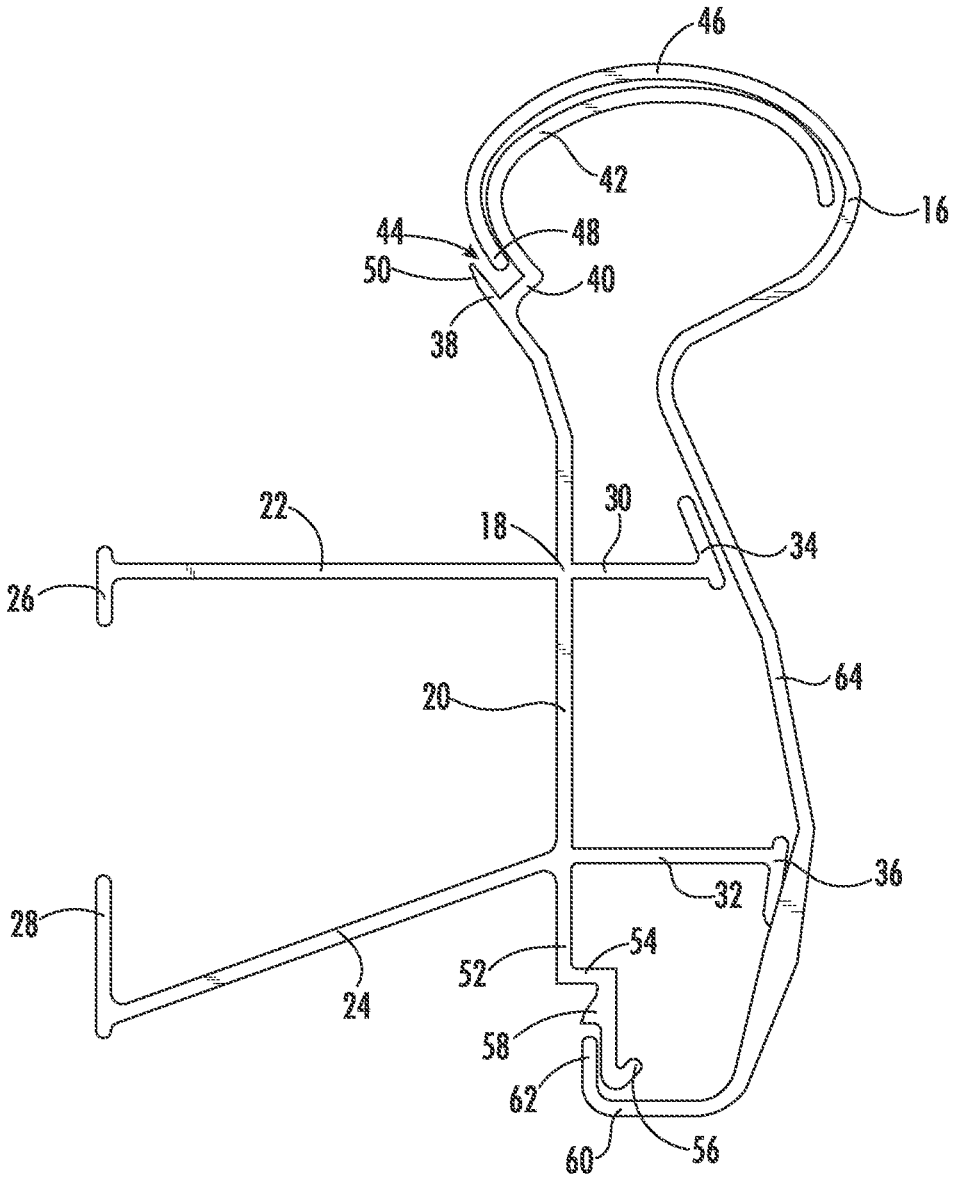
FIG. 3 depicts a cross-sectional view of the handrail system of FIG. 1 taken along line 3-3, showing the structural member and cover, according to an exemplary embodiment.

Turning to FIG. 3, a cross-sectional view of the support member 18 and the cover 16 taken along the longitudinal axis a is shown. In embodiments, the support member 18 is made from extruded aluminum. Advantageously, each of the structure shown in the cross-sectional view of FIG. 3 and that will be discussed below can be formed directly in the extrusion process. In other embodiments, the support member 18 can be made from another material, such as another metal or a plastic. The support member 18 has a central strip 20 that, when installed, is substantially parallel to the mounting surface. Extending substantially perpendicularly from a first lateral side of the central strip 20 that faces the mounting surface is a mounting arm 22. Also extending from the first lateral side of the central strip 20 is an angled mounting arm 24. In embodiments, the angled mounting arm 24 is angled relative to the central strip 20 at an angle of, e.g., from 91° to 135°. At the end of the mounting arm 22 is a first mounting strip 26, and at the end of the angled mounting arm 24 is a second mounting strip 28. The mounting strips 26, 28 are configured to abut the mounting surface when installed.

A first support arm 30 and a second support arm 32 extend away from the second lateral side of the central strip 20 that faces away from the mounting surface. As shown in FIG. 3, the first support arm 30 is in line with the mounting arm 22 such that the central strip 20, mounting arm 22, and first support arm 30 form a junction in the support member 18. As is also shown in FIG. 3, the second support arm 32 is in line with the place where the angled mounting arm 24 extends from the central strip 20 such that the central strip 20, angled mounting arm 24, and second support arm 32 also form a junction in the support member 18. The support arms 30, 32 are designed to provide support for the cover 16 so that the cover 16 maintains its contour when installed on the support member 18. In furtherance of this function, a first support panel 34 is disposed at an end of the first support arm 30, and a second support panel 36 is disposed at an end of the second support arm 32. As can be seen in FIG. 3, the support panels 34, 36 are angled relative to the support arms 30, 32 to match the contour of the cover 16 in the region in which the cover 16 contacts the support panels 34, 36.

On a first longitudinal side, the central strip 20 also includes a curved extension 38. With respect to the orientation of the central strip 20 shown in FIG. 3, the curved extension 38 extends upwardly from the central strip 20. Further, in embodiments, the curved extension 38 curves toward the mounting surface. Proximal to a distal end of the curved extension 38 is a first projection 40. The first projection 40 extends substantially perpendicularly from the curved extension 38. At the end of the first projection 40 is a curved support section 42 creating a curved surface over which the cover 16 is supported. The curved extension 38, first projection 40, and curved support section 42 create a slot 44 into which the cover 16 terminates. In particular, the cover 16 includes a first curved section 46 having a curvature that substantially matches the curvature of the curved support section 42 and that hooks over the curved support section 42, and a first edge 48 of the cover 16 terminates in the slot 44. In embodiments, the curved extension 38 has a tapered surface 50 designed to match the curvature of the cover 16 in the region where it enters the slot 44. By terminating the cover 16 in the slot 44, a patient cannot easily grip the first edge 48 to try to pry to the cover 16 from the support member 18.

On a second longitudinal side of the support member 18 opposite to the curved extension 38 is a depending extension 52. Depending extension 52 is substantially in line with the central strip 20. A second projection 54 extends from an end of the depending extension 52 in the second lateral direction and toward the cover 16. Further, extending from the second projection 54 is a ledge 56. A protrusion 58 juts from a surface of the ledge 56 that faces the mounting surface. As shown in FIG. 3, the cover 16 includes a second curved section 60 with a second edge 62. The second curved section 60 is configured to slide over the front face of and around the ledge 56 such that the second edge 62 abuts or is in close proximity to the protrusion 58. Similar to the slot 44 into which the first edge 48 terminates, the proximity of the protrusion 58 and the second edge 62 makes gripping the second edge 62 more difficult, especially for the purpose of prying the second curved section 60 from around the ledge 56. Together, curved support section 42, projection 40, curved extension 38, central strip 20, depending extension 52, projection 54, ledge 56, and protrusion 58 define a base member of support member 18. As shown in FIG. 3, when installed, cover 16 engages the first side of the base member, facing the mounting wall, at a first location that is beneath mounting arms 22, 24, covers the second side of the base member, facing away from the mounting, and engages the first side of the base member at a second location that is above mounting arms 22, 24 and within slot 44.

Between the first curved section 46 and the second curved section 60 of the cover 16 is a contoured section 64. The contoured section 64 can be of any of a variety of suitable contours available for handrail designs. As mentioned above, the support panels 34, 36 maintain the contour of the contoured section 64. Further, in embodiments, the cover 16 is formed in such a way and from such a material that the cover 16 has to be flexed to fit it over the curved support section 42 and the ledge 56. In this way, the cover 16 will be in tight engagement with the curved support section 42, the support panels 34, 36, and the ledge 56. Advantageously, the tight engagement diminishes any wiggle room or play between the cover 16 and the support member 18, which might be exploited to facilitate removal of the cover 16 from the support member 18.

Figure 4:
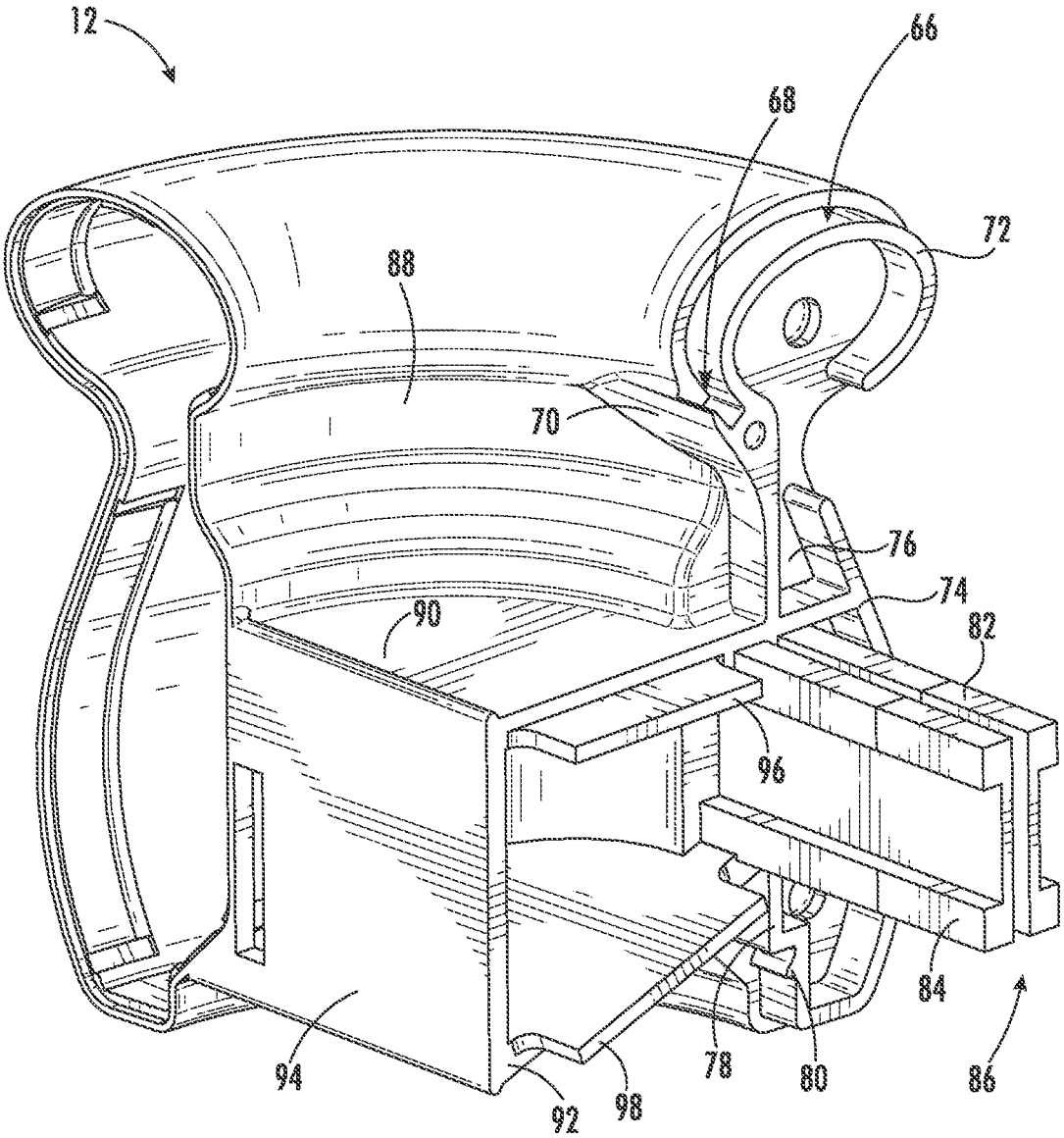
FIG. 4 depicts a perspective view of an endcap of the handrail system, according to an exemplary embodiment.

With reference now to FIG. 4, endcap 12 is depicted. Endcap 14 is substantially similar to endcap 12 but is a mirror inverse structure. Thus, discussion of endcap 12 applies as well to endcap 14. The endcaps 12, 14 are configured to mate with the support member 18. Additionally, like support member 18, the endcaps 12, 14 are configured such that the cover 16 locks into the endcaps 12, 14 in a manner that makes removal of the cover 16 difficult. Thus, as shown in FIG. 4, the endcap 12 includes an engagement section 66 having a slot 68 formed by a curved extension 70 and a curved support section 72. As with the support member 18 of FIG. 3, the first edge 48 of the retainer cover 16 terminates in the slot 68. In embodiments, the curved extension 70 includes a tapered surface 72 designed to match the curvature of the cover 16 in the region where it enters the slot 68. As shown in FIG. 1, when cover 16 is coupled to endcap 12 and support member 18, the outer surface of cover 16 aligns substantially flush with the outer surface of endcap 12 where the outer surface of cover 16 abuts the outer surface of endcap 12.

Further, the endcap 12 also includes a contoured ridge 74 that extends substantially perpendicularly from a side surface 76 of the endcap 12. The contoured ridge 74 is similar in function to the support panels 34, 36 and to the ledge 56 of the support member 18 as shown in FIG. 3. That is, the contoured ridge 74 supports the contoured section 64 of the cover 16 and provides a structure for the second edge 62 of the cover 16 to slide over and around. Thus, the contoured ridge 74 extends along the side surface 76 from a location proximal to the curved extension 70 downwardly to the bottom (with respect to the orientation shown in FIG. 4) of the endcap 12 and curves toward the mounting surface and then back upwardly to form a central ridge 78, leading to the curved extension 70 and curved support section 72. As with the ledge 56 shown in FIG. 3, a protrusion 80 extends from a portion of the central ridge 78 proximal to where the contoured ridge 74 turns upwardly on the endcap 12. The second edge 62 abuts or is in close proximity to the protrusion 80, which makes gripping the second edge 62 more difficult, especially for the purpose of prying the second curved section 60 of the cover 16 from around the contoured ridge 74 of the endcap 12.

The endcap 12 includes multiple structures configured to engage the support member 18. Extending from the side surface 76 of the endcap 12 are a first plank 82 and a second plank 84. The first plank 82 extends from a first side of the central ridge 78, and the second plank 84 extends from a second side of the central ridge 78. In this way, the planks 82, 84 are separated by at least a distance corresponding to the thickness of the central ridge 78. In this way, the planks 82, 84 define a slot 86 adapted to receive the central strip 20 of the support member 18. During installation, one or more holes are drilled (or may be pre-drilled) through the planks 82, 84 and the central strip 20, and a fastener (e.g., a self-tapping screw) is inserted through each hole to join the endcap 12 to the support member 18.

The endcap 12 includes an interior surface 88 from which a first panel 90 extends. The first panel 90 is arranged substantially perpendicularly to the central ridge 78. Also extending from the interior surface 88 of the endcap 12 is an angled second panel 92. The first panel 90 and the second panel 92 are joined by a mounting panel 94 that is arranged substantially perpendicularly to the first panel 90. Upon installation, the mounting panel 94 abuts the mounting surface. The first mounting panel 90 includes a first lip 96, and the second mounting panel 92 includes a second lip 98. The lips 96, 98 are positioned such that they insert between the mounting arm 22 and the angled mounting arm 24 of the support member 18 and such that the first panel 90 forms a substantially continuous surface with the mounting arm 22 and such that the second panel 92 forms a substantially continuous surface with the angled mounting arm 24 (e.g., as shown in FIG. 2).

As can be seen in FIG. 4, the endcap 12 has an arcuate structure. Specifically, the endcap 12 has a degree of curvature of about 90°. In this way, the endcap 12 caps the cover 16 and support member 18, which are arranged parallel to the mounting surface, and transitions the end of the handrail system 10 into the wall. However, in other embodiments the endcaps 12, 14 can instead be inside or outside corners that join sections of the handrail system 10. That is, where two mounting surfaces meet, a first support member 18 and cover 16 can be installed on one mounting surface 11, and a second support member 18 and cover 16 can be installed on the other mounting surface 11. The two sections can be joined at the corner where the mounting surfaces meet, e.g., an inside corner where the angle between the mounting surfaces 11 is less than 180° or an outside corner where the angle between the mounting surfaces 11 is greater than 180°. The endcap 12 or endcap 14 will be angled to match the angle of the inside or outside corner and will have two engagement sections 66 at opposite ends of the endcap 12 or 14 to facilitate connection to both sections of the handrail system 10.

Figure 5:
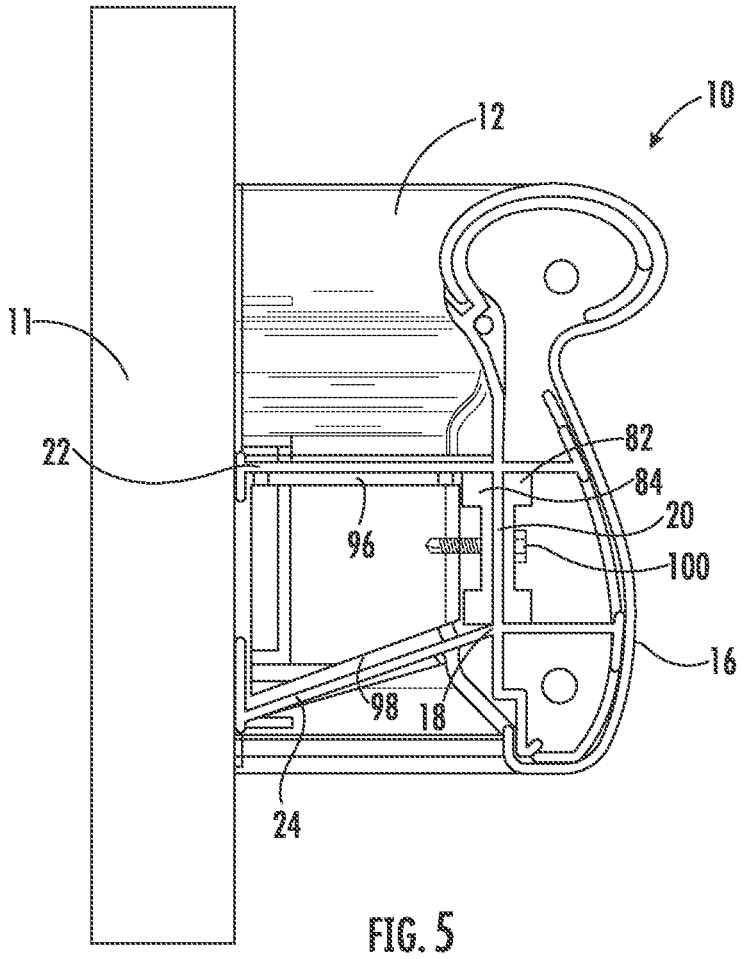
FIG. 5 depicts a cross-sectional view of the handrail system of FIG. 1 taken along line 5-5, showing the attachment of the endcap to the structural member, according to an exemplary embodiment.
Figure 6:
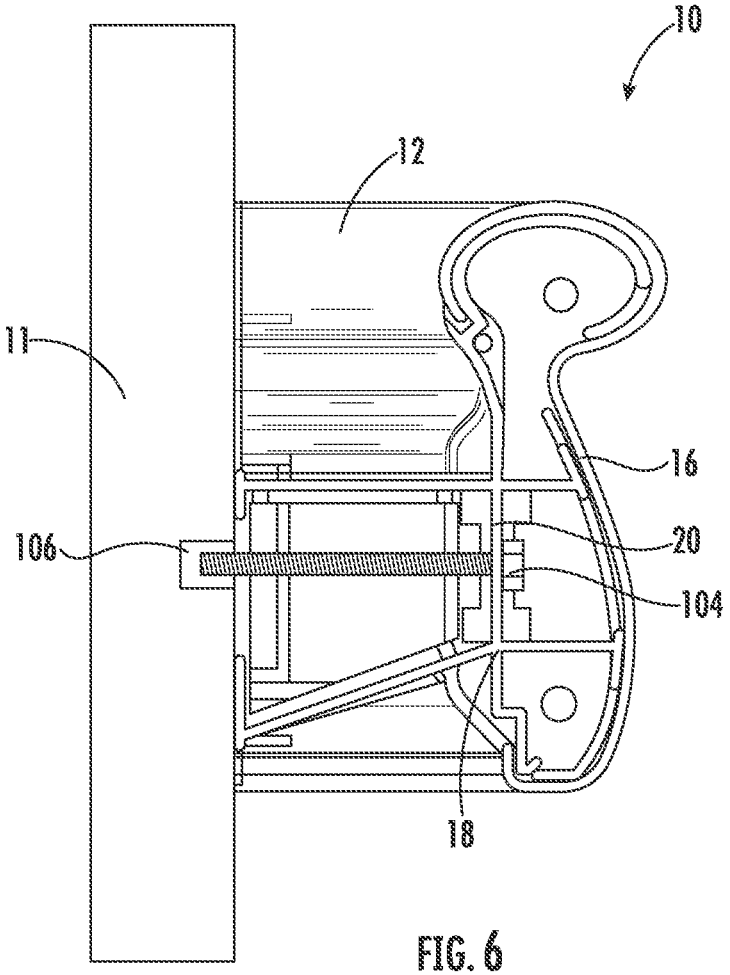
FIG. 6 depicts a cross-sectional view of the handrail system of FIG. 1 taken along line 6-6, showing the attachment of the structural member to the mounting surface, according to an exemplary embodiment.

As mentioned above, the handrail system 10 as described herein is simpler to install than other conventional designs. In order to install the handrail system 10 on a mounting surface 11, the endcaps 12, 14 may first be attached to the support member 18. As shown in FIG. 5, the planks 82, 84 are placed on either side of the central strip 20, and a fastener 100, such as a self-tapping screw, is inserted through the planks 82, 84 and central strip 20. In embodiments, the endcaps 12, 14 are only attached to the support member 18 and are not otherwise attached to the mounting surface 11. However, in other embodiments, the mounting panel 94 may be provided with an adhesive or bonding agent to attach the endcap 12, 14 to the mounting surface 11 in addition to being secured to the support member 18. After securing the endcaps 12, 14 to the support member 18, the support member 18 is connected to the mounting surface 11 as shown in FIG. 6. A fastener 104 is inserted through a hole in the central strip 20 of the support member 18. The hole may be drilled at the time of installation or the hole may be predrilled. The fastener 104 is then secured to a threaded structure 106 in the mounting surface 11. In the embodiment depicted, the threaded structure 106 is a threaded insert embedded, e.g., into a wall stud. In other embodiments, the threaded structure 106 can be a drywall anchor, a toggle bolt, a molly, etc. The number of fasteners 104 used to secure the support member 18 to the mounting surface 11 will depend, at least in part, on the length of the support member 18. For example, a fastener 104 may be placed every two to six feet along the length of the support member 18 to secure the support member 18 to the mounting surface 11. While the installation method described involves attaching the endcaps 12, 14 to the support member 18 prior to attaching the support member 18 to the mounting surface 11, in other embodiments the endcaps 12, 14 can be attached after the support member 18 after attaching the support member 18 to the mounting surface 11.

Once the support member 18 and endcaps 12, 14 are secured to the mounting surface 11, the cover 16 is snapped onto support member 18 and endcaps 12, 14. In an embodiment, the second edge 62 of the second curved section 60 of the cover 16 is hooked under the ledge 56 such that the second edge 48 abuts or is in close proximity to the protrusion 58 of the ledge 56. The first edge 48 of the first curved section 46 is then flexed over the curved support section 42 such that the first edge 48 of the first curved section 46 is inserted into the slot 44. As the first edge 48 slides into the slot 44, the cover 16 recovers from its flexed state to a relaxed state, which provides tight conformance of the cover 16 to the support member 18 and the endcaps 12, 14 and completes the installation.

Thus, the installation of the handrail system 10 can be completed in three steps: (1) attaching the endcaps 12, 14 to the support member 18; (2) attaching the support member 18 to the mounting surface 11; and (3) attaching the cover 16 to the support member 18. Further, a basic installation only requires four components: the two endcaps 12, 14, the support member 18, and the cover 16. Conventional handrail designs often require additional steps and a greater number components for the installation. For example, many handrail designs require a mounting bracket be installed on the wall. In such designs, a retainer strip for the endcaps and cover is provided and attached to the mounting bracket. Thus, these designs incorporate at least one additional component and an additional installation step.

In various exemplary embodiments, the relative dimensions, including angles, lengths and radii, as shown in the Figures are to scale. Actual measurements of the Figures will disclose relative dimensions and angles of the various exemplary embodiments. Various exemplary embodiments include any combination of one or more relative dimensions or angles that may be determined from the Figures. Further, actual dimensions not expressly set out in this description can be determined by using the ratios of dimensions measured in the Figures in combination with the express dimensions set out in this description.

The use of the terms "a" and "an" and "the" and similar referents in the context of describing the invention (especially in the context of the following claims) is to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Further modifications and alternative embodiments of various aspects of the invention will be apparent to those skilled in the art in view of this description. Accordingly, this description is to be construed as illustrative only. The construction and arrangements, shown in the various exemplary embodiments, are illustrative only. Although only a few embodiments have been described in detail in this disclosure, many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. Some elements shown as integrally formed may be constructed of multiple parts or elements, the position of elements may be reversed or otherwise varied, and the nature or number of discrete elements or positions may be altered or varied. The order or sequence of any process, logical algorithm, or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A handrail configured to be installed on a mounting wall, the handrail comprising:

an elongate support member having a first longitudinal end, a second longitudinal end, and a longitudinal axis extending through the first longitudinal end and the second longitudinal end, the support member comprising:

a base member having a first side that faces toward the mounting wall when the handrail is installed and a second side that faces away from the mounting wall when the handrail is installed, the base member defining a base member slot in the first side;

an endcap having a first endcap end and a second endcap end, the endcap coupled to the first longitudinal end of the support member at the first endcap end, and the endcap forming an arcuate shape that defines an arc between the first endcap end and the second endcap end;

a cover comprising a first edge, a second edge opposite the first edge, and a substantially continuous surface extending between the first edge and second edge, the substantially continuous surface covering at least a portion of the support member and at least a portion of the endcap;

wherein the second edge engages the first side of the base member at a first location, the substantially continuous surface covers the second side of the base member, and the first edge engages the first side of the base member at a second location within the base member slot such that the slot surrounds the first edge on at least three sides; and wherein an outer surface of the cover abuts and aligns substantially flush with an outer surface of the endcap;

wherein the endcap defines an endcap slot within an interior of the arc defined by the arcuate shape, and wherein the cover engages the endcap at least at a first location within the endcap slot; and wherein the support member further comprises a first mounting arm extending from the first side of the base member and a second mounting arm spaced apart from the first mounting arm and extending from the first side of the base member, the first mounting arm and the second mounting arm each configured to engage the mounting wall when the handrail is installed, and wherein the endcap further comprises a first mounting panel having a first outer surface that forms a substantially continuous surface with the first mounting arm and a second mounting panel having a second outer surface that forms a substantially continuous surface with the second mounting arm.

2. The handrail of claim 1, wherein a first lip protrudes from the first mounting panel, wherein a second lip protrudes from the second mounting panel, wherein the first lip and the second lip are inserted between the first mounting arm and the second mounting arm.

3. The handrail of claim 1, wherein the endcap slot is positioned above the first mounting panel and the second mounting panel, wherein the endcap further comprises a protrusion positioned beneath the first mounting panel and the second mounting panel, and wherein the cover extends to cover an upper portion of the endcap, a side of the endcap opposite the first mounting panel and the second mounting panel and a lower portion of the endcap and engages the endcap at a location beneath and in close proximity to the protrusion.

4. The handrail of claim 1, wherein the arc defined by the arcuate shape of the endcap defines a degree of curvature of 90 degrees.

5. The handrail of claim 1, wherein the endcap is comprised of impact resistant plastic.

6. A handrail configured to be installed on a mounting wall, the handrail comprising:

an elongate support member having a first longitudinal end, a second longitudinal end, and a longitudinal axis extending through the first longitudinal end and the second longitudinal end, the support member comprising:

a base member having a first side that faces toward the mounting wall when the handrail is installed and a second side that faces away from the mounting wall when the handrail is installed, the base member defining a base member slot in the first side;

an endcap having a first endcap end and a second endcap end, the endcap coupled to the first longitudinal end of the support member at the first endcap end, and the endcap forming an arcuate shape that defines an arc between the first endcap end and the second endcap end;

a cover comprising a substantially continuous surface that covers at least a portion of the support member and at least a portion of the endcap;

wherein the cover engages the first side of the base member at a first location, covers the second side of the base member, and engages the first side of the base member at a second location within the base member slot; and wherein an outer surface of the cover abuts and aligns substantially flush with an outer surface of the endcap;

wherein the endcap defines an endcap slot within an interior of the arc defined by the arcuate shape, and wherein the cover engages the endcap at least at a first location within the endcap slot; and wherein the support member further comprises a first mounting arm extending from the first side of the base member and a second mounting arm spaced apart from the first mounting arm and extending from the first side of the base member, the first mounting arm and the second mounting arm each configured to engage the mounting wall when the handrail is installed, and wherein the endcap further comprises a first mounting panel having a first outer surface that forms a substantially continuous surface with the first mounting arm and a second mounting panel having a second outer surface that forms a substantially continuous surface with the second mounting arm.

7. The handrail of claim 6, wherein a first lip protrudes from the first mounting panel, wherein a second lip protrudes from the second mounting panel, wherein the first lip and the second lip are inserted between the first mounting arm and the second mounting arm.

8. The handrail of claim 6, wherein the endcap slot is positioned above the first mounting panel and the second mounting panel, wherein the endcap further comprises a protrusion positioned beneath the first mounting panel and the second mounting panel, and wherein the cover extends to cover an upper portion of the endcap, a side of the endcap opposite the first mounting panel and the second mounting panel and a lower portion of the endcap and engages the endcap at a location beneath and in close proximity to the protrusion.

* * * * *